US008459477B2

(12) United States Patent
Roodenburg et al.

(10) Patent No.: US 8,459,477 B2
(45) Date of Patent: Jun. 11, 2013

(54) HOISTING CRANE AND VESSEL WITH SUCH A CRANE

(75) Inventors: Joop Roodenburg, Delft (NL); Diederick Bernardus Wijning, Schiedam (NL); Terence Willem August Vehmeijer, The Hague (NL); Robert Frodo Van Kuilenburg, Hellevoetssluis (NL)

(73) Assignee: ITREC B.V., Schiedam (NL)

( * ) Notice: Subject to any disclaimer, the term of this patent is extended or adjusted under 35 U.S.C. 154(b) by 864 days.

(21) Appl. No.: 12/527,313

(22) PCT Filed: Feb. 15, 2008

(86) PCT No.: PCT/NL2008/000045

§ 371 (c)(1),
(2), (4) Date: Oct. 26, 2009

(87) PCT Pub. No.: WO2008/100137

PCT Pub. Date: Aug. 21, 2008

(65) Prior Publication Data

US 2010/0102017 A1 Apr. 29, 2010

Related U.S. Application Data

(60) Provisional application No. 60/901,661, filed on Feb. 16, 2007.

(51) Int. Cl.
*B66C 23/42* (2006.01)

(52) U.S. Cl.
USPC ..... 212/295; 212/298

(58) Field of Classification Search
USPC ..... 212/294, 295, 296, 297, 298, 204
See application file for complete search history.

(56) References Cited

U.S. PATENT DOCUMENTS

| | | | | | |
|---|---|---|---|---|---|
| 2,414,573 | A | * | 1/1947 | Wagner et al. | 212/253 |
| 3,161,299 | A | * | 12/1964 | Noly | 212/296 |
| 3,361,268 | A | * | 1/1968 | Pingon | 212/295 |
| 3,388,810 | A | * | 6/1968 | Durand | 212/296 |
| 3,433,368 | A | * | 3/1969 | Durand | 212/295 |
| 3,446,362 | A | | 5/1969 | Banks, Jr. | |
| 3,557,968 | A | * | 1/1971 | Thaeter | 212/233 |
| 3,631,988 | A | * | 1/1972 | Noly | 212/295 |

(Continued)

FOREIGN PATENT DOCUMENTS

| | | | |
|---|---|---|---|
| DE | 26 42 910 | A1 | 3/1978 |
| GB | 2 025 349 | A | 1/1980 |
| WO | WO-2005/123566 | A2 | 12/2005 |

*Primary Examiner* — Emmanuel M Marcelo

(74) *Attorney, Agent, or Firm* — Birch, Stewart, Kolasch & Birch, LLP

(57) ABSTRACT

A hoisting crane with a substantially hollow vertical column with a foot which is or can be fixed to a support, and with a top, an annular bearing structure, which extends around the vertical column and guides and carries a jib connection member, so that the jib connection member can rotate around the column, a jib connected to the jib connection member, the jib connection member forming a substantially horizontal pivot axis so that the jib can be pivoted up and down, a column top cable guide having a topping cable and hoisting cable pulley assembly, a topping winch and an associated topping cable for pivoting the jib up and down, a hoisting winch and an associated hoisting cable for hoisting a load; wherein the column top cable guide is mounted via an associated rotary bearing structure at the top of the column.

19 Claims, 16 Drawing Sheets

U.S. PATENT DOCUMENTS 3,709,375 A * 1/1973 Morrison et al. ..... 212/235
3,938,670 A * 2/1976 Wellman ..... 212/296
3,944,081 A * 3/1976 Wellman ..... 212/296
4,126,361 A * 11/1978 Bottner et al. ..... 384/455
4,187,949 A * 2/1980 Komatsu ..... 212/307
4,216,870 A * 8/1980 Bonneson et al. ..... 212/223
4,363,410 A * 12/1982 Sprengel ..... 212/307
4,524,875 A * 6/1985 Jamieson ..... 212/239
5,016,768 A * 5/1991 Kennard et al. ..... 212/262

* cited by examiner

HOISTING CRANE AND VESSEL WITH SUCH A CRANE

BACKGROUND OF THE INVENTION

This application is the National Phase of PCT/NL2008/000045 filed on Feb. 15, 2008, which claims priority under 35 U.S.C. 119(e) to U.S. Provisional Application No. 60/901,661 filed on Feb. 16, 2007, all of which are hereby expressly incorporated by reference into the present application.

The invention relates to a hoisting crane comprising:

- a substantially hollow vertical column with a foot which is or can be fixed to a support, and with a top,
- an annular bearing structure, which extends around the vertical column and guides and carries a jib connection member, so that the jib connection member can rotate around the column,
- a jib connected to the jib connection member, the jib connection member forming a substantially horizontal pivot axis so that the jib can be pivoted up and down,
- a column top cable guide having a topping cable and hoisting cable pulley assembly,
- a topping winch and an associated topping cable for pivoting the jib up and down,
- a hoisting winch and an associated hoisting cable for hoisting a load;

wherein the topping winch and the hoisting winch are disposed such that the hoisting cable and the topping cable extend from the associated winch upward through the column to the column top cable guide and from said column top cable guide to the jib, wherein the jib has topping cable pulley assembly for the topping cable and a hoisting cable pulley assembly for the hoisting cable,

- wherein the column top cable guide is mounted via an associated rotary bearing structure at the top of the column, such that said column top cable guide follows rotary movements of the jib about the vertical column and adopts substantially the same angular position as the jib. Hoisting cranes of this type, also known as a Heavy Lift Mast Crane (HLMC) have already been commercially available from the applicant for decades, and have in particular been installed on vessels, such as for example a cargo vessel, transport vessel, a tender vessel used in the offshore industry, marine pipelaying vessel, drilling vessel, etc.

As is preferred the vertical column of the hoisting crane has a substantially continuous outer wall. The horizontal section through the vertical column is substantially circular from the jib connection member to the top, with the cross section gradually decreasing towards the top of the column. The column has a foot which is often substantially rectangular, which has the advantage that the foot can easily be secured (by welding or using bolts) to the longitudinal and transversal bulkheads of a hull of a vessel of which an example is shown in FIG. 1.

The known hoisting crane is popular for vessels that have been specially designed for over sea transport of large and heavy equipment. Capacities in a range from 200 mt up to 1600 mt and load moments in a range from 3000 tm up to 40,000 tm are possible.

FIG. 1 shows an example of a pipelaying and heavy lift vessel equipped with a hoisting crane as described above. Here, the hoisting crane is provided with a fly-jib, which forms the end of the jib. At about a quarter length from the distal end of the jib, a topping cable pulley assembly is mounted to connect the multiple fall topping cable to the jib. Many known hoisting cranes do not have a fly-jib and are provided with a topping cable pulley assembly at the end of the jib. The multiple fall topping cable functions to move the jib up- and downwards.

The upward or topped position of the jib is defined by an angle (angle $\alpha$ in FIG. 1), which is formed between a centerline of the jib and the multiple fall topping cable. When this angle $\alpha$ becomes too small, it is not possible to top the jib further upward anymore. In such a situation the multiple fall topping cable lies nearly parallel to the jib. Thus, a higher vertical column of the crane would permit the jib to be pivoted further in upward direction and with this the hoisting crane can handle larger objects. A higher vertical column is also advantageous during hoisting when the jib is in a lower, e.g. substantial horizontal position.

The forces, which occur when hoisting a heavy load, introduce less tension in the topping cable, when the hoisting crane is designed with a bigger angle $\alpha$ between the topping cables and the jib, when the jib is in the horizontal position. Normally in open sea there are no difficulties with the large geometry of the hoisting crane, but a great height of the crane does effectively limit the operational area of the vessel with such a crane. For example, sometimes the vessel has to come close to a large building on the quayside, close to a drilling rig, or it has to travel inland and pass under a structure like a bridge.

SUMMARY OF THE INVENTION

In view of the situation outlined above it is an object of the present invention to propose solutions that allow for a large topping angle of the jib, while at the same time allowing for a relative low or reduced height of the crane, in particular such that less limitations are placed on the deployment of the vessel compared to a vessel equipped with the prior art design of the crane. It is noted that in practical embodiments the crane still may be very tall, yet would even be taller without the proposed inventive solutions.

According to a first aspect thereof the present invention provides a hoisting crane comprising:

- a substantially hollow vertical column with a foot which is or can be fixed to a support, and with a top,
- an annular bearing structure, which extends around the vertical column and guides and carries a jib connection member, so that the jib connection member can rotate around the column,
- a jib connected to the jib connection member, the jib connection member forming a substantially horizontal pivot axis so that the jib can be pivoted up and down,
- a column top cable guide having a topping cable and hoisting cable pulley assembly,
- a topping winch and an associated topping cable for pivoting the jib up and down,
- a hoisting winch and an associated hoisting cable for hoisting a load;

wherein the topping winch and the hoisting winch are disposed such that the hoisting cable and the topping cable extend from the associated winch upward through the column to the column top cable guide and from said column top cable guide to the jib, wherein the jib has topping cable pulley assembly for the topping cable and a hoisting cable pulley assembly for the hoisting cable,

- wherein the column top cable guide is mounted via an associated rotary bearing structure at the top of the column, such that said column top cable guide follows rotary movements of the jib about the vertical column and adopts substantially the same angular position as the jib, wherein a mobile subframe is mounted on column top cable guide, said mobile subframe supporting an intermediate topping cable pulley assembly along which the topping cable passes between the column top cable guide and the jib, such that—in a topped up position of the jib—an angle α between the jib and the topping cable is greater than the angle between jib and an imaginary line from the topping cable pulley assembly on the jib to the topping cable pulley assembly of the column top cable guide.

In a practical embodiment the mobile subframe is connected pivotally to the column top cable guide allowing the subframe to pivot up and down. In a preferred embodiment the mobile subframe is free to pivot such that the orientation thereof is governed by the orientation of the jib. An example thereof is shown in FIGS. 15*a, b*, whereas another example of a crane according to the first aspect of the invention is shown in FIG. 14.

According to a second aspect of the invention a hoisting crane comprises:

a substantially hollow vertical column with a foot which is or can be fixed to a support, and with a top, an annular bearing structure, which extends around the vertical column and guides and carries a jib connection member, so that the jib connection member can rotate around the column, a jib connected to the jib connection member, the jib connection member forming a substantially horizontal pivot axis so that the jib can be pivoted up and down, a column top cable guide having a topping cable and hoisting cable pulley assembly, a topping winch and an associated topping cable for pivoting the jib up and down, a hoisting winch and an associated hoisting cable for hoisting a load;

wherein the topping winch and the hoisting winch are disposed such that the hoisting cable and the topping cable extend from the associated winch upward through the column to the column top cable guide and from said column top cable guide to the jib, wherein the jib has topping cable pulley assembly for the topping cable and a hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, wherein the vertical column comprises at least a lower and an upper column part, the lower column part being integral with the foot, the annular bearing structure extending around the lower column part, the cable guide being arranged on the top of the upper column part, the upper and lower column part being connected to each other by a height adjustment arrangement, which permits the upper column part to move relative to the lower column part between a working position and a transport position wherein the total height of the vertical column is reduced with respect to the working position.

Advantageously, the effective height of the hoisting crane according to the invention is substantially determined by the height of the lower column part, when the upper column part is positioned in a transport position. The reduction of the height of the vertical column permits the hoisting crane to pass under obstacles like bridges, etc. Preferably a reduction of the total height is obtained of at least 5 meter. More in particular a reduction of the total height of the hoisting crane in the transport position is obtained of 10 meter. When the upper column part is positioned in a working position, the hoisting crane is able to withstand the occurring loads and tensions.

According to a third aspect thereof the present invention provides a hoisting crane comprising:

a substantially hollow vertical column with a foot which is or can be fixed to a support, and with a top, an annular bearing structure, which extends around the vertical column and guides and carries a jib connection member, so that the jib connection member can rotate around the column, a jib connected to the jib connection member, the jib connection member foaming a substantially horizontal pivot axis so that the jib can be pivoted up and down, a column top cable guide having a topping cable and hoisting cable pulley assembly, a topping winch and an associated topping cable for pivoting the jib up and down, a hoisting winch and an associated hoisting cable for hoisting a load;

wherein the topping winch and the hoisting winch are disposed such that the hoisting cable and the topping cable extend from the associated winch upward through the column to the column top cable guide and from said column top cable guide to the jib, wherein the jib has topping cable pulley assembly for the topping cable and a hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, wherein external to the vertical column a framework is provided connected to the jib connection member having an intermediate topping cable guide assembly opposite the jib, spaced at a radial distance from the vertical column to increase the angle α between the topping cable and the jib.

According to a fourth aspect thereof the present invention provides a hoisting crane, comprising:

a substantially hollow vertical column with a foot which is or can be fixed to a support, and with a top, an annular bearing structure, which extends around the vertical column and guides and carries a jib connection member, so that the jib connection member can rotate around the column, a jib connected to the jib connection member, the jib connection member forming a substantially horizontal pivot axis so that the jib can be pivoted up and down, a column top cable guide having a topping cable and hoisting cable pulley assembly, a topping winch and an associated topping cable for pivoting the jib up and down, a hoisting winch and an associated hoisting cable for hoisting a load;

wherein the topping winch and the hoisting winch are disposed such that the hoisting cable and the topping cable extend from the associated winch upward through the column to the column top cable guide and from said column top cable guide to the jib, wherein the jib has topping cable pulley assembly for the topping cable and a hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, wherein a pivot assembly is arranged at the foot of the vertical column, which permits the vertical column to be tilted from a working position to a transport position, so that the effective height of the vertical column is reduced with respect to the working position.

The invention further relates to a vessel equipped with a crane as disclosed herein.

Further advantageous embodiments are described in the dependent claims and in the following description with reference to the drawings.

DETAILED DESCRIPTION OF THE DRAWINGS

Figure 1:
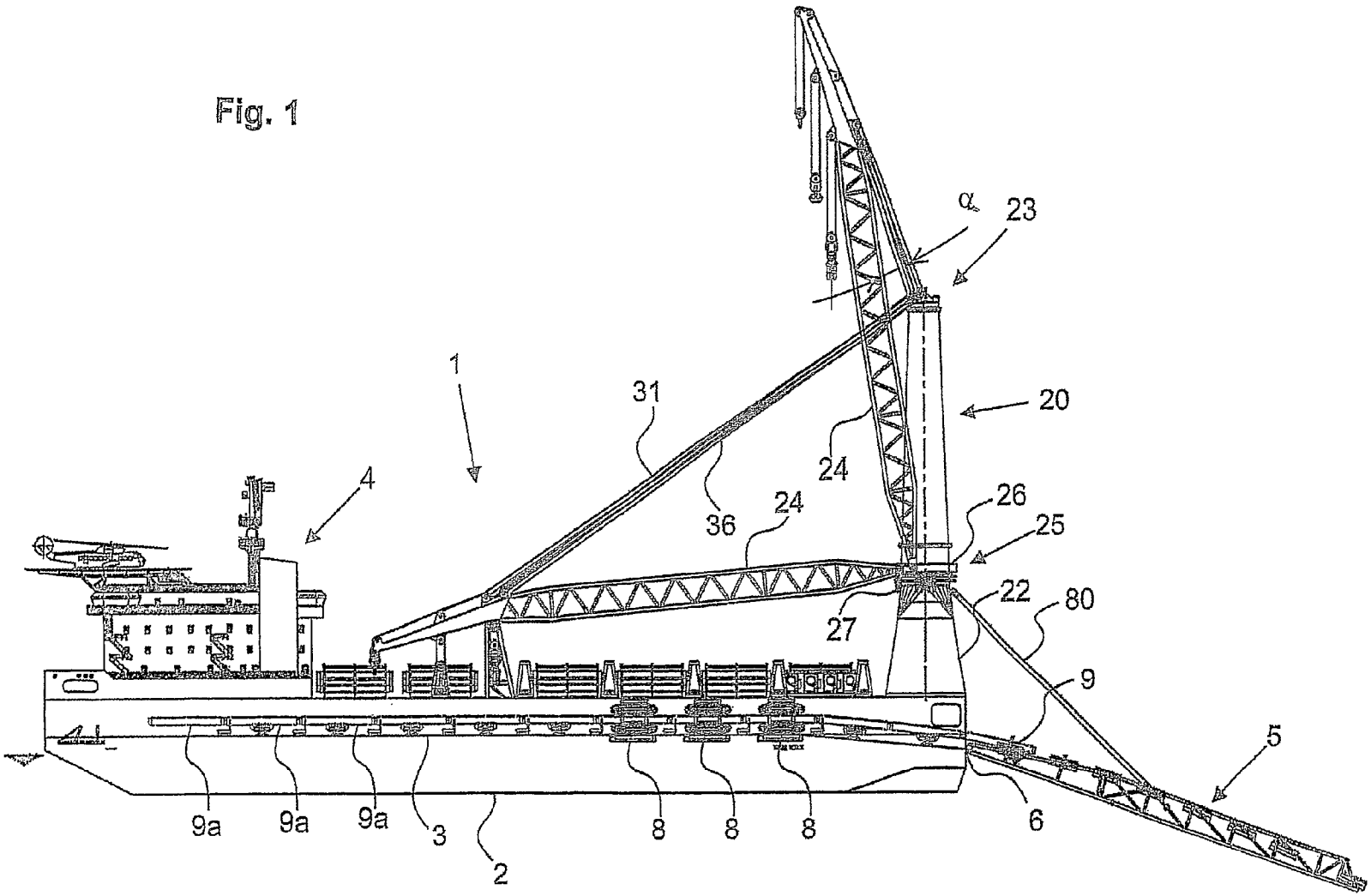
FIG. 1 diagrammatically depicts a prior art offshore vessel which is suitable, inter alia, for laying a pipeline on the seabed.

FIG. 1 shows an offshore vessel 1 which is suitable, inter alia, for laying a pipeline on the seabed and lifting of heavy and large loads, e.g. a topside of a drilling platform.

The vessel 1 has a hull 2 with a working deck 3 and, at the front of the hull 2, a superstructure 4 for crew accommodation, etc.

The vessel 1 is provided with a pipeline-laying installation of the S-lay type, with one or more welding stations on the working deck 3, for coupling pipeline sections 9*a* in a substantially horizontal orientation. On the working deck 3 there are also what are known as tensioners 8 for carrying the weight of the pipeline 9 which is hanging downwards from the vessel 1.

Furthermore, the vessel 1 has a stinger 5 which projects outside the hull 2 of the vessel 1 at the rear side of the vessel 1, engages on the hull 2 at an engagement point such that it can pivot about a substantially horizontal pivot structure 6 and forms a downwardly curved support for pipeline moving towards the seabed.

Furthermore, the vessel 1 has a hoisting crane 20, disposed in the vicinity of the same side of the hull as the stinger 5, which hoisting crane 20 has a vertical structure fixed to the hull 2. The hoisting crane 20 will be described in more detail below. Here, the crane 20 is disposed above the location where the pipeline 9 leaves the working deck 3, on the longitudinal axis of the vessel 1.

The vessel 1 can be used to lay a pipeline 9, but also for hoisting work, such as the hoisting work carried out, for example, in the offshore industry when installing platforms, underwater installations, etc.

Figure 2:
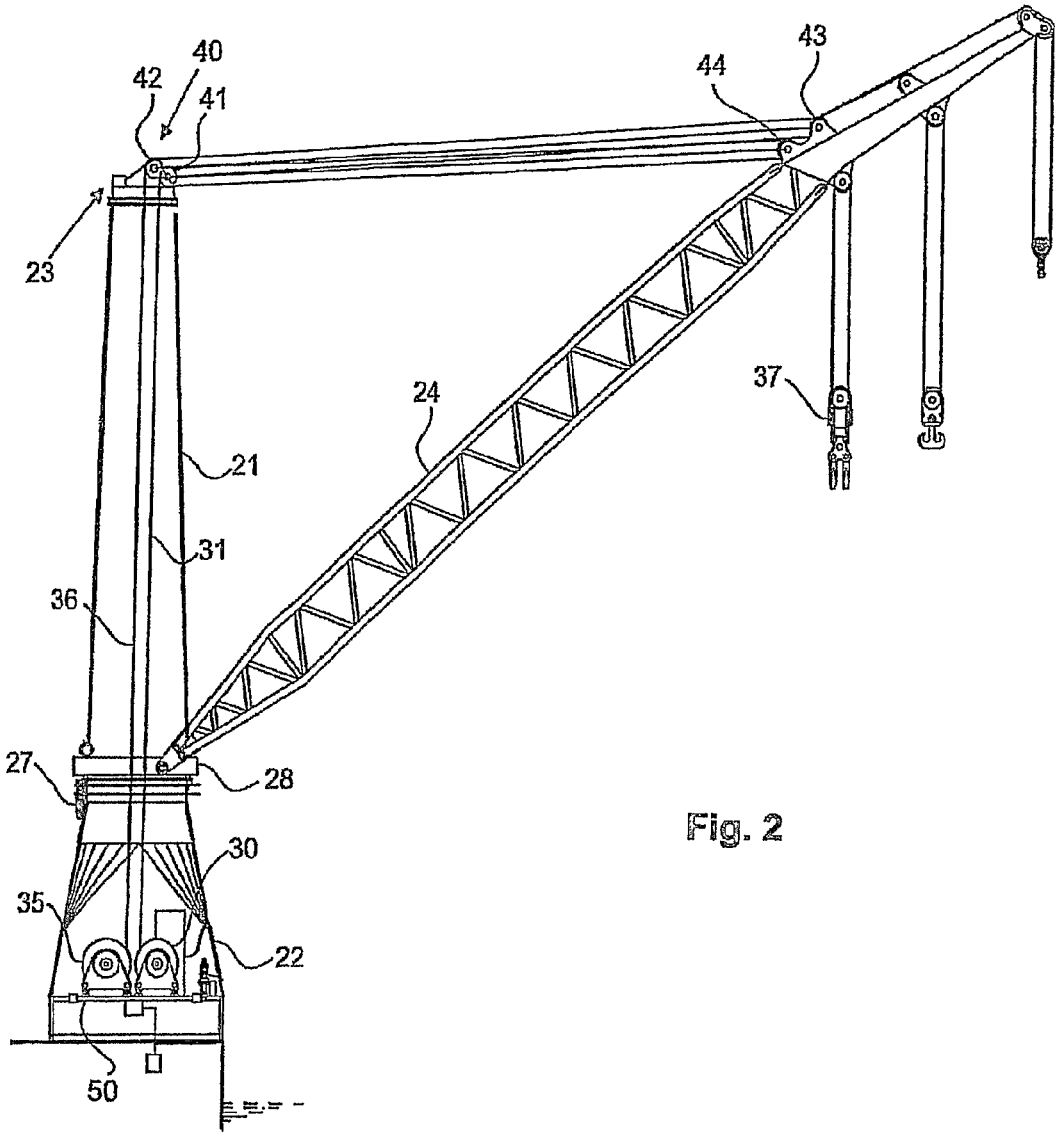
FIG. 2 shows the hoisting crane at the rear side of the vessel shown in FIG. 1, partially in the form of a cut-away view.
Figure 3:
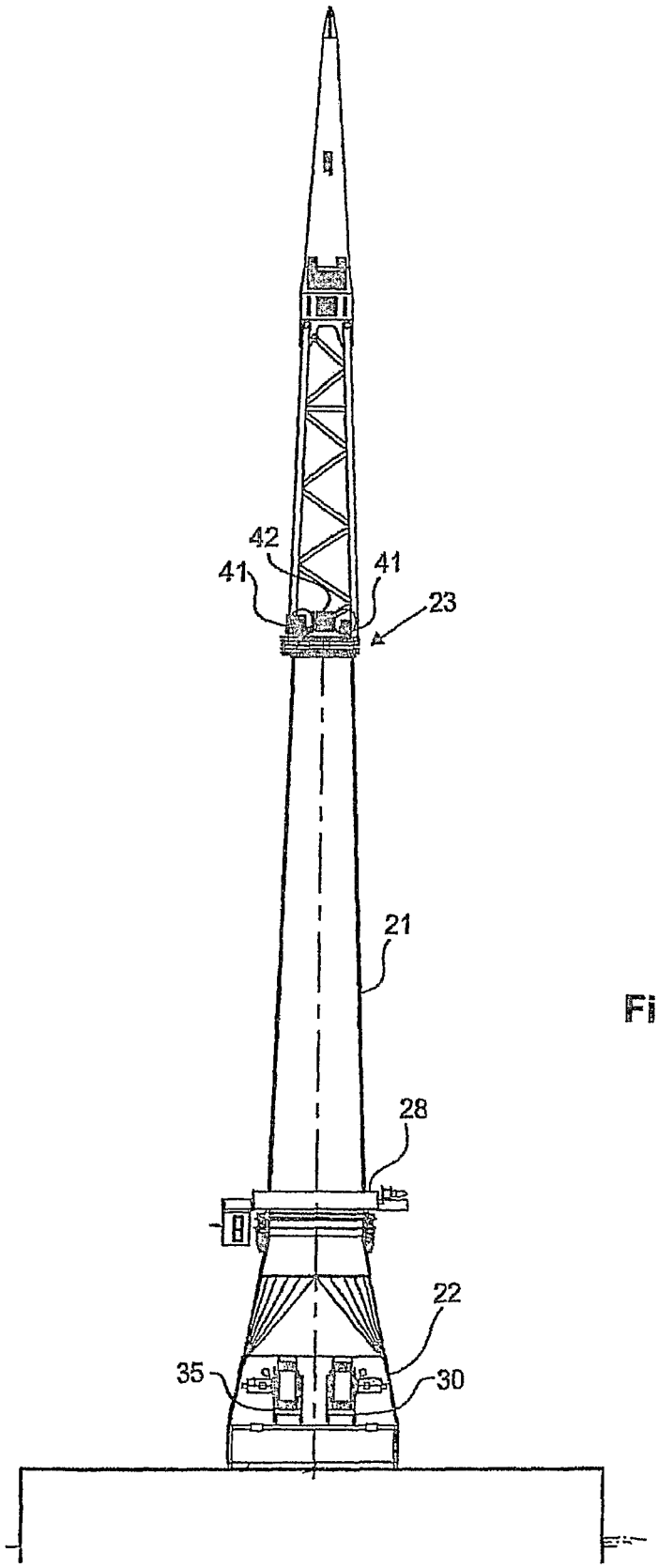
FIG. 3 shows the hoisting crane from FIG. 2 from a different direction.
Figure 4:
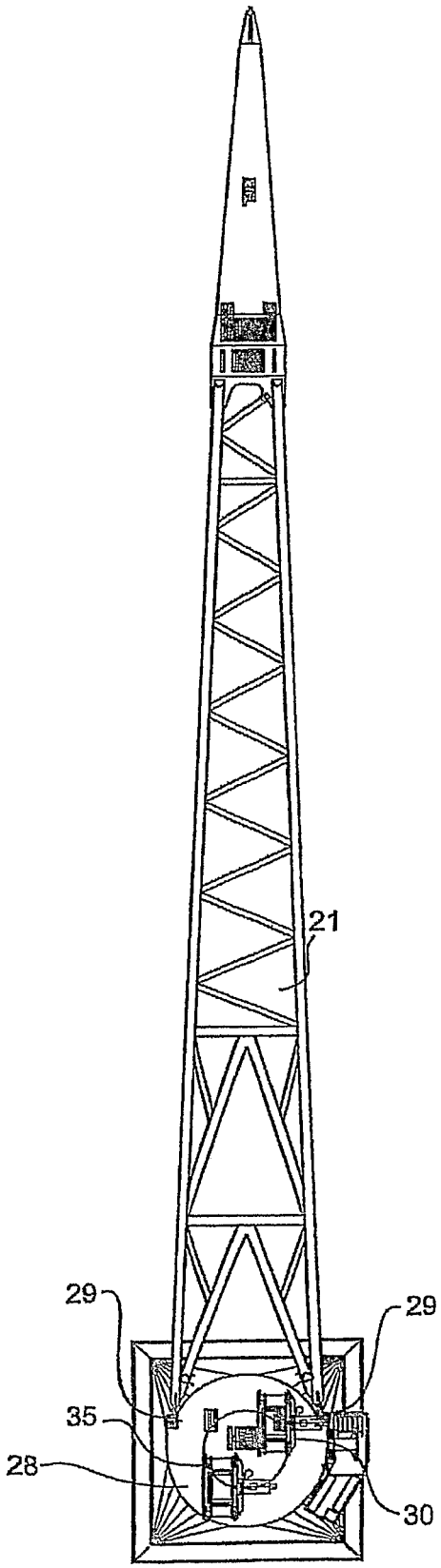
FIG. 4 shows a view of the hoisting crane shown in FIGS. 2 and 3 from above.

The hoisting crane 20, which is illustrated in detail in FIGS. 2-4, has a substantially hollow vertical column 21 with a foot 22, which in this case is fixed to the hull 2 of the vessel 1. Furthermore, the column 21 has a top 23.

The hoisting crane 20 has a jib 24, which is illustrated in two different positions in FIG. 1. An annular bearing structure 25 extends around the vertical column 21 and guides and carries a jib connection member 26, so that the jib connection member 26, and therefore the jib 24, can rotate about the column 21. This motion is commonly referred to as the slewing motion.

In this case, the jib connection member 26 forms a substantially horizontal pivot axis, so that the jib 24 can be pivoted up and down. There is at least one drive motor 27 for displacing the jib connection member 26 along the annular bearing structure 25. By way of example, the annular bearing structure 25 comprises one or more guide tracks which extend around the column 21 and on which an annular component 28 of the jib connection member 26 is supported via running wheels. Jib securing supports 29 are arranged on the component 28 at two positions. The drive motor 27 may, for example, drive a pinion which engages with a toothed track around the column 21.

To pivot the jib 24 up and down, there is a topping winch 30 provided, here inside the lower part of the column, which is shown in FIG. 2 with a topping cable 31 which engages on the jib 24.

Furthermore, the hoisting crane 20 comprises a hoisting winch 35 for raising and lowering a load, with an associated hoisting cable 36 and a hoisting hook 37. At the top 23 of the column 21 there is a column top cable guide 40 provided with a topping cable pulley assembly 41 for the topping cable 31 and with a hoisting cable pulley assembly 42 for the hoisting cable 36.

One or more cable pulley assemblies 43 for the hoisting cable 36 and a jib topping cable pulley assembly 44 for the topping cable 31 are arranged on the jib 24. The number of cable parts or falls for each cable can be selected as appropriate by the person skilled in the art.

The winches 30 and 35 are in this case—as is preferred—disposed in the foot 22 of the vertical column 21, so that the topping cable 31 and the hoisting cable 36 extend from the associated winch 30, 35 upward, through the hollow vertical column 21 to the column top cable guide 40 and then towards the cable guides 43, 44 on the jib 24.

The column top cable guide 40 has a rotary bearing structure, for example with one or more running tracks around the top 23 of the column 21 and running wheels, engaging on the running tracks. As a result, the column top cable guide 40 can follow rotary (slewing) movements of the jib 24 about the vertical column 21 and adopt substantially the same angular position as the jib 24.

The column top cable guide 40 may have an associated drive motor assembly which ensures that the cable guide 40 follows the slewing movements of the jib 24 about the column 21, but an embodiment without drive motor assembly is preferred.

The winches 31 and 35 are in this example arranged on a rotatable winch support 50, which is mounted rotatable with respect to the vertical column 21. The winch support 50 here is located in the vertical column structure, preferably in the region of the foot 22 under the circular cross section part of the column 21, and is mechanically decoupled from the column top cable guide 40. The support 50 could e.g. also be arranged in the hull of the vessel below the column, e.g. the foot could have an extension which extends into the hull.

Figure 5:
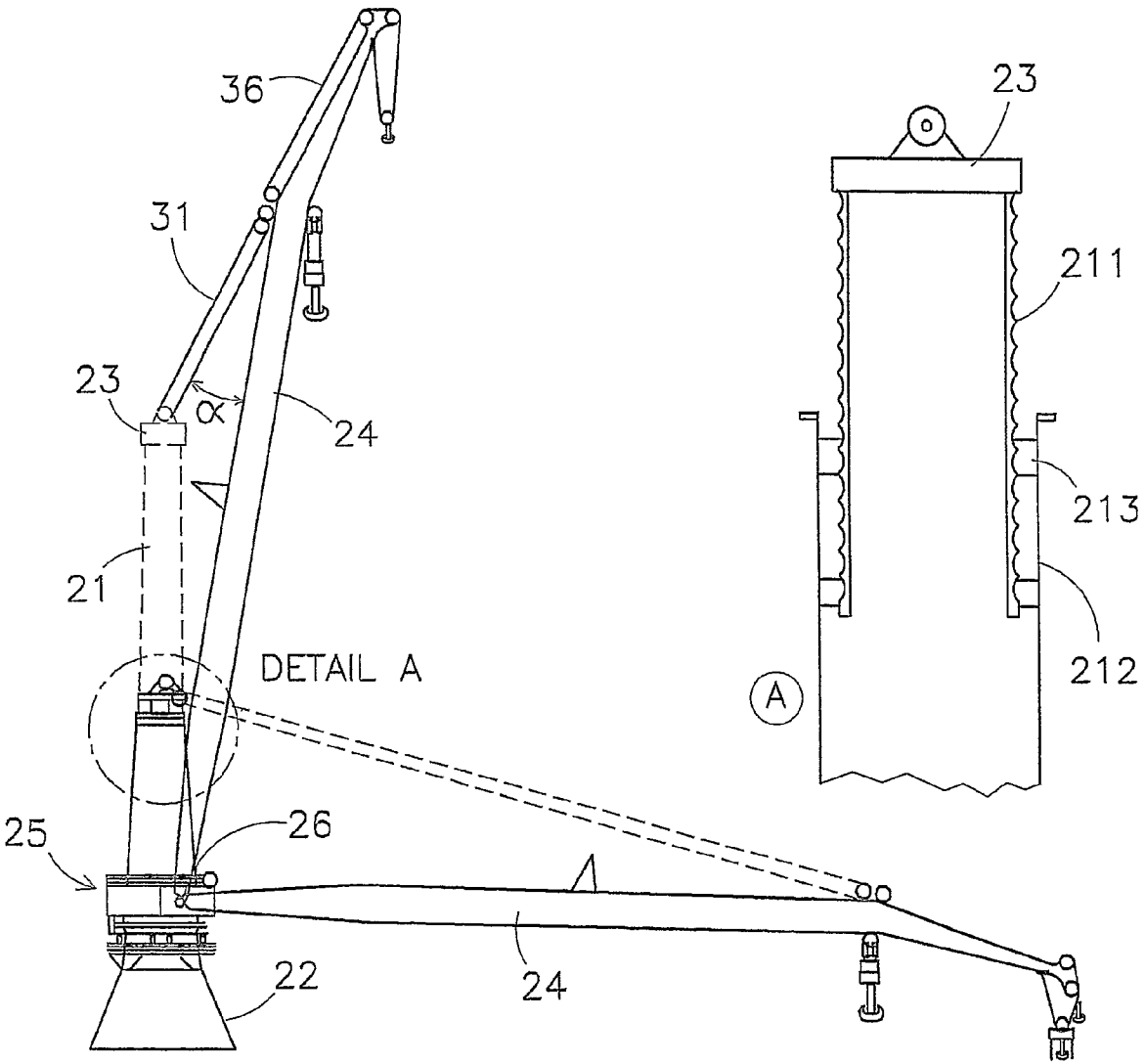
FIG. 5 shows schematically a hoisting crane according to the invention provided with a height adjustment arrangement.

FIG. 5 shows a first embodiment of the hoisting crane according to the invention. The hoisting crane has a vertical column which comprises an upper column part 211, a lower column part 212 and a height-adjustment arrangement. The lower column part 212 has a foot 22 which can be fixed to the hull of a vessel. A jib 24 is connected to the lower column part 212 via a connection member 26 and an annular bearing structure 25. The lower column part 212 is hollow. The height adjustment arrangement in this example comprises cooperating screw threads, e.g. M8000 (which means a screw thread having a diameter of about 8 meter) or equivalent means like arrays of pins which cooperate with a groove, which are provided directly or indirectly via at least a lower and an upper ring 213*a*, 213*b* on the lower column part 212 and on the upper column part 211. The rings 213 are rotatable connected to the lower column part. The upper column part 211 comprises a corresponding screw thread at its outer surface. The screw thread of the upper column part engages on the screw thread of the lower column part 212 or of the rings 213 connected to the lower column part 212. The provision of the corresponding screw threads on the lower and upper column part forms the height-adjustment arrangement and permits a translation of the upper column part relative to the lower column part. Herewith, the total height of the vertical column is adjustable by rotating the upper column part relative to the lower column part or alternatively by rotating the rings 213. To rotate the upper column part or the rings 213 relative to the lower column part a separate drive is envisaged. The upper column part is movable to-and-fro a first upper position which is a working position of the hoisting crane and a second lower position which is a transport position of the hoisting crane. In the transport position of the upper column part, the total height of the vertical column is reduced so far to allow a vessel with a hoisting crane according to the invention to pass obstacles, like bridges, on its way.

Figure 6:
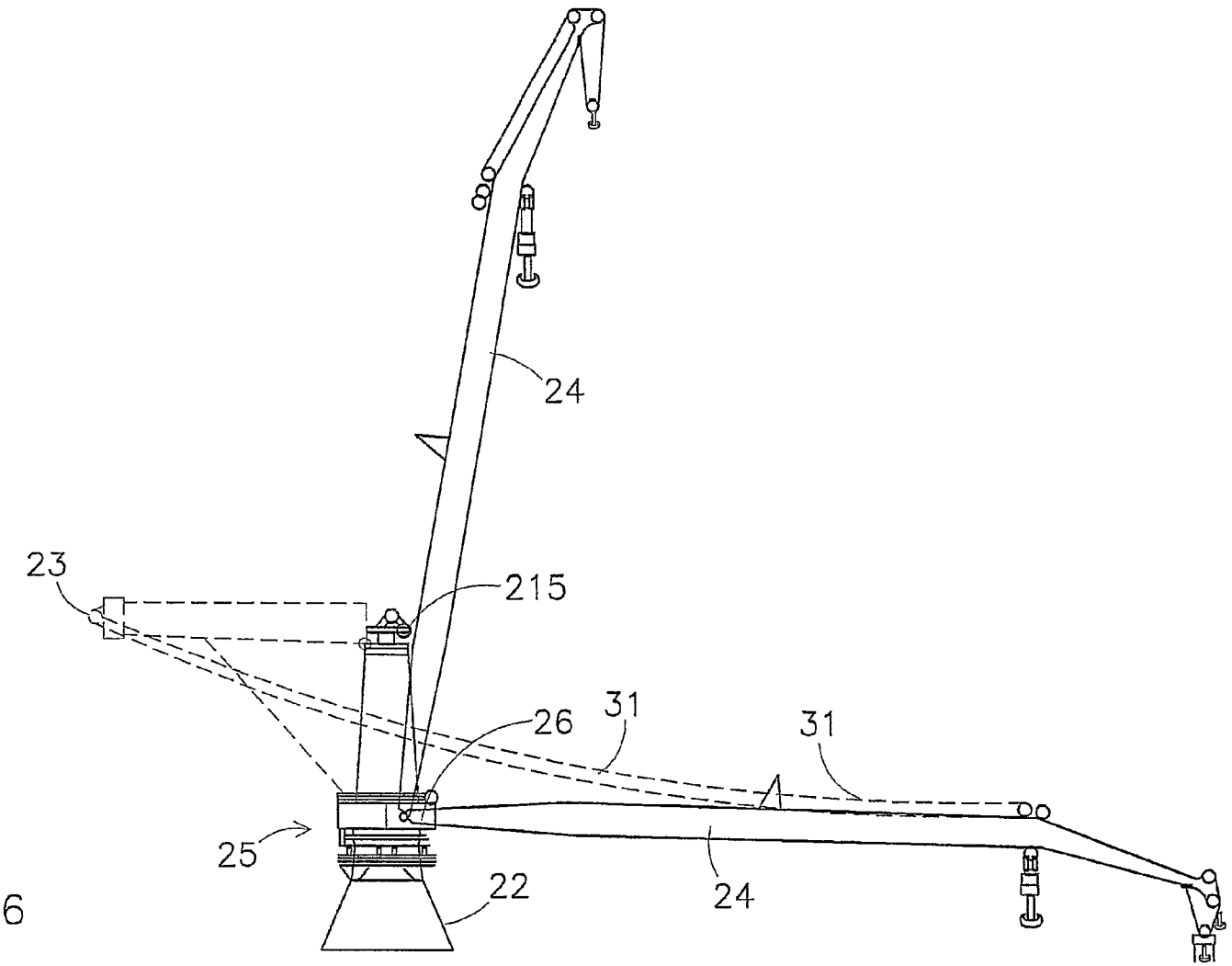
FIG. 6 shows schematically a hoisting crane according to the invention provided with a pivot assembly as a height adjustment arrangement.
Figure 7:
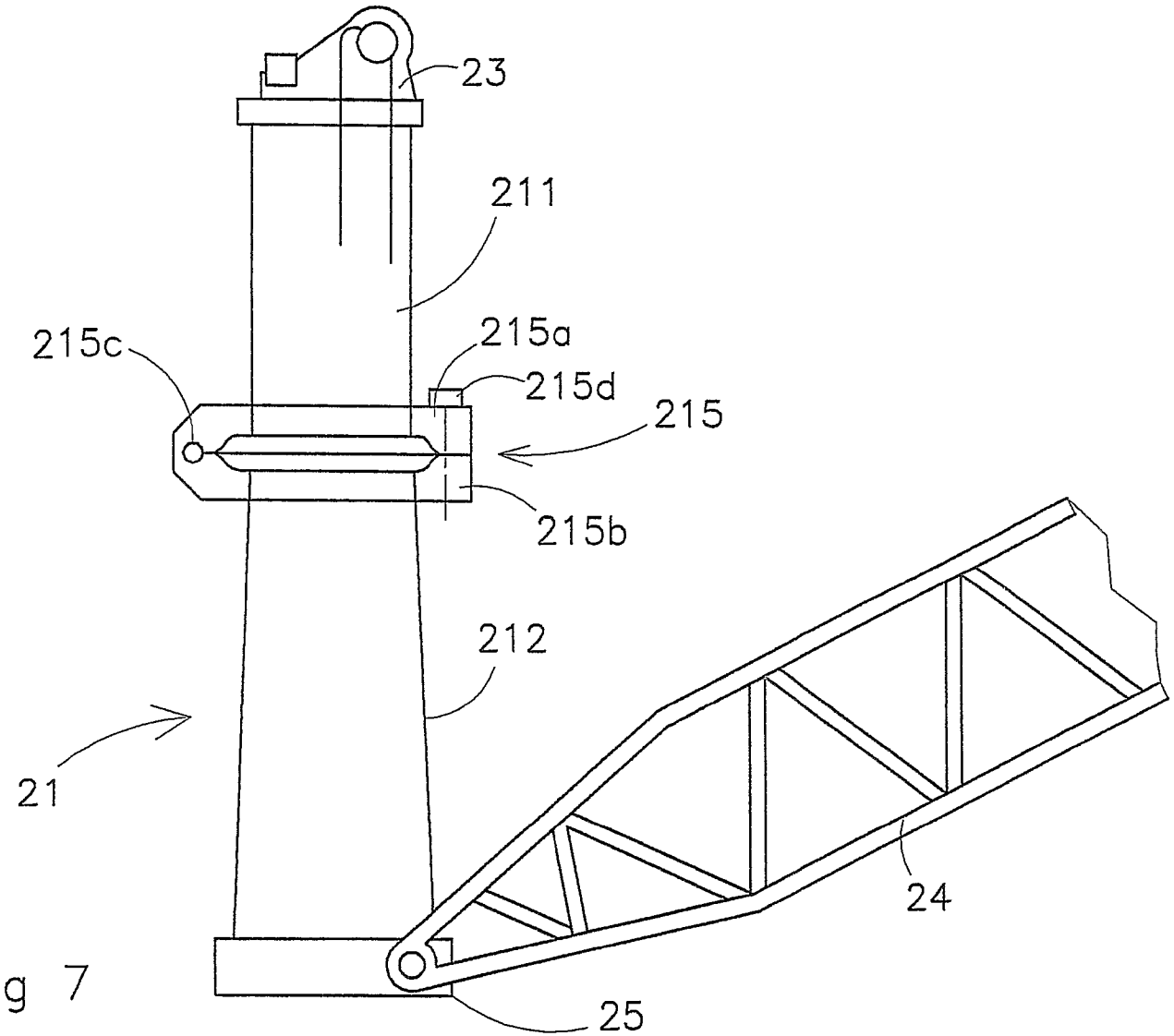
FIG. 7 shows schematically a vertical column of a crane according to the invention provided with a pivot assembly.
Figure 8:
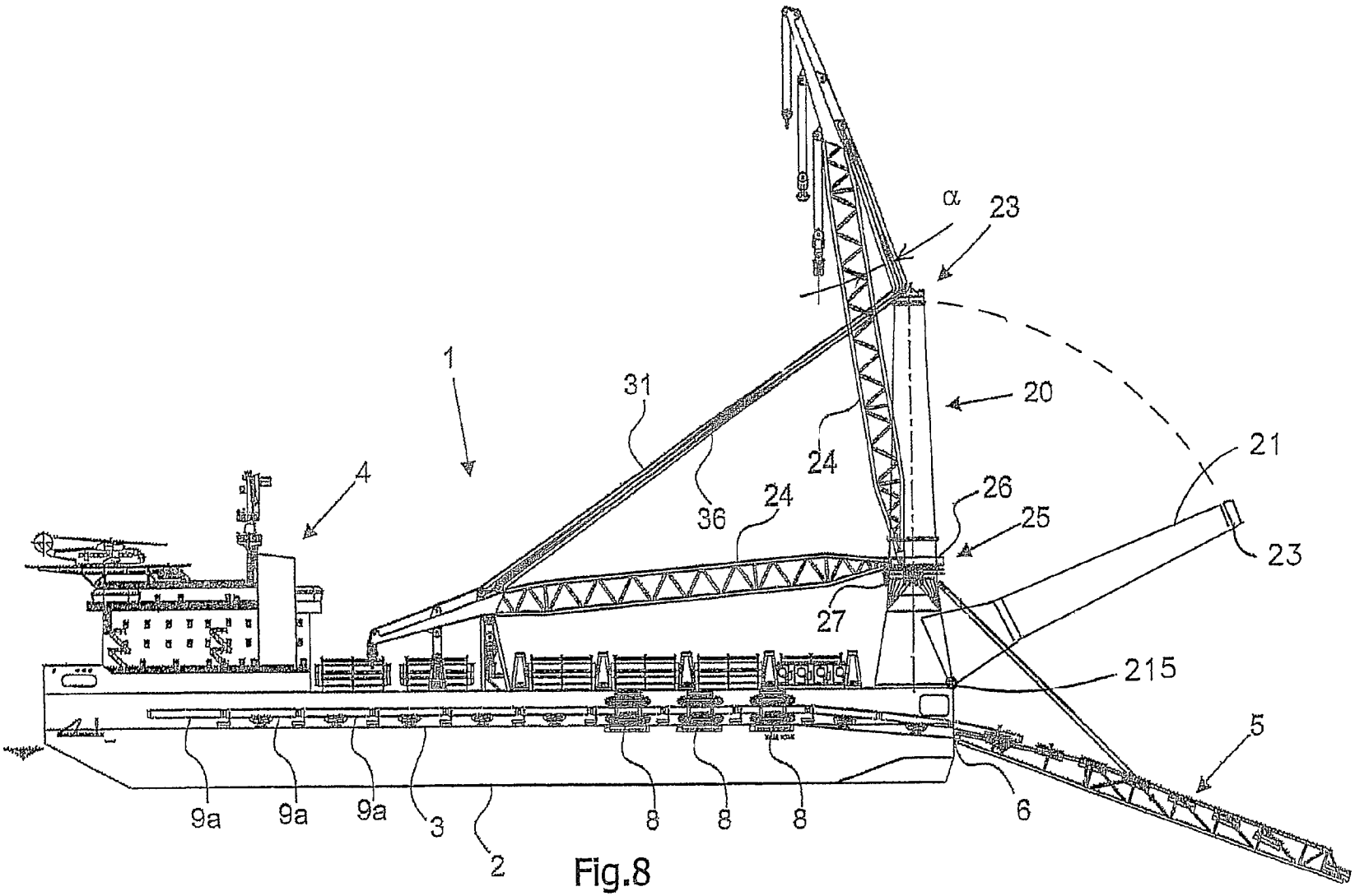
FIG. 8 shows schematically a hoisting crane according to the invention on a offshore vessel provided with a height adjustment arrangement.

FIGS. 6-8 show other exemplary embodiments of the hoisting crane according to the invention provided with a height-adjustment arrangement. The illustrated hoisting crane in FIG. 6 has a vertical column 21 which comprises an upper column part 211 and a lower column part 212. The upper column part 211 is connected to the lower column part 212 with a pivot assembly 215 as a height-adjustment arrangement. The pivot assembly 215 permits the upper column part 211 to turn over to a substantially horizontal position, which is a transport position. Eventually, a support frame is provided to support the upper column part in its transport position. The topping cables and the hoisting cables are used in a method to move the upper column part to and fro its transport position. It is further possible to use hydraulic cylinders to move the upper column part to and fro the transport position. In the transport position the height of the vertical column 21 is limited which allows a vessel with a hoisting crane according to the invention to pass underhead structures, like bridges.

FIG. 7 shows a particular embodiment of the pivot assembly 215 shown in FIG. 6. The pivot assembly 215 comprises two pivot flanges 215*a*, 215*b* which are rotatable relative to each other over a pivot shaft 215*c*. The first pivot flange 215*a* is connected to the upper column part 211 and the second pivot flange is connected to the lower column part 212 by welding. When the upper column part is in its vertical position, the hoisting crane is in the working position. In this position the pivot flange s are in abutting engagement with each other. At least one bolt 215*d* is envisaged to strengthen the structure of the pivot assembly 215. The bolt 215*d* connects the pivot flange s 215*a*, 215*b* to each other.

FIG. 8 shows an alternative embodiment of the hoisting crane according to the invention with a pivot assembly mounted in the lower region of the vertical column 21. The foot 22 of the vertical column 21 is connected to a pivot assembly 215, which is connected to the hull 2 of the vessel 1. The pivot assembly 215 as a height-adjustment arrangement allows the vertical column to turn over to reduce its total height. The jib 24 can be used to control the movement of the vertical column 21 to and fro a transport position. It is advantageous to tilt the column 21 in a direction to the jib 24, because this causes pressure forces into the jib, which makes it easier to control the movement with the jib. In the transport position the column 21 has tilted in a length direction of the vessel to the front- or rearside of the vessel. The transport position of the vertical column may be a position of the vertical column at the rear of the vessel (as shown), but may also be a position above the vessel. A support frame may be provided to support the column 21 in its transport position.

Figure 9:
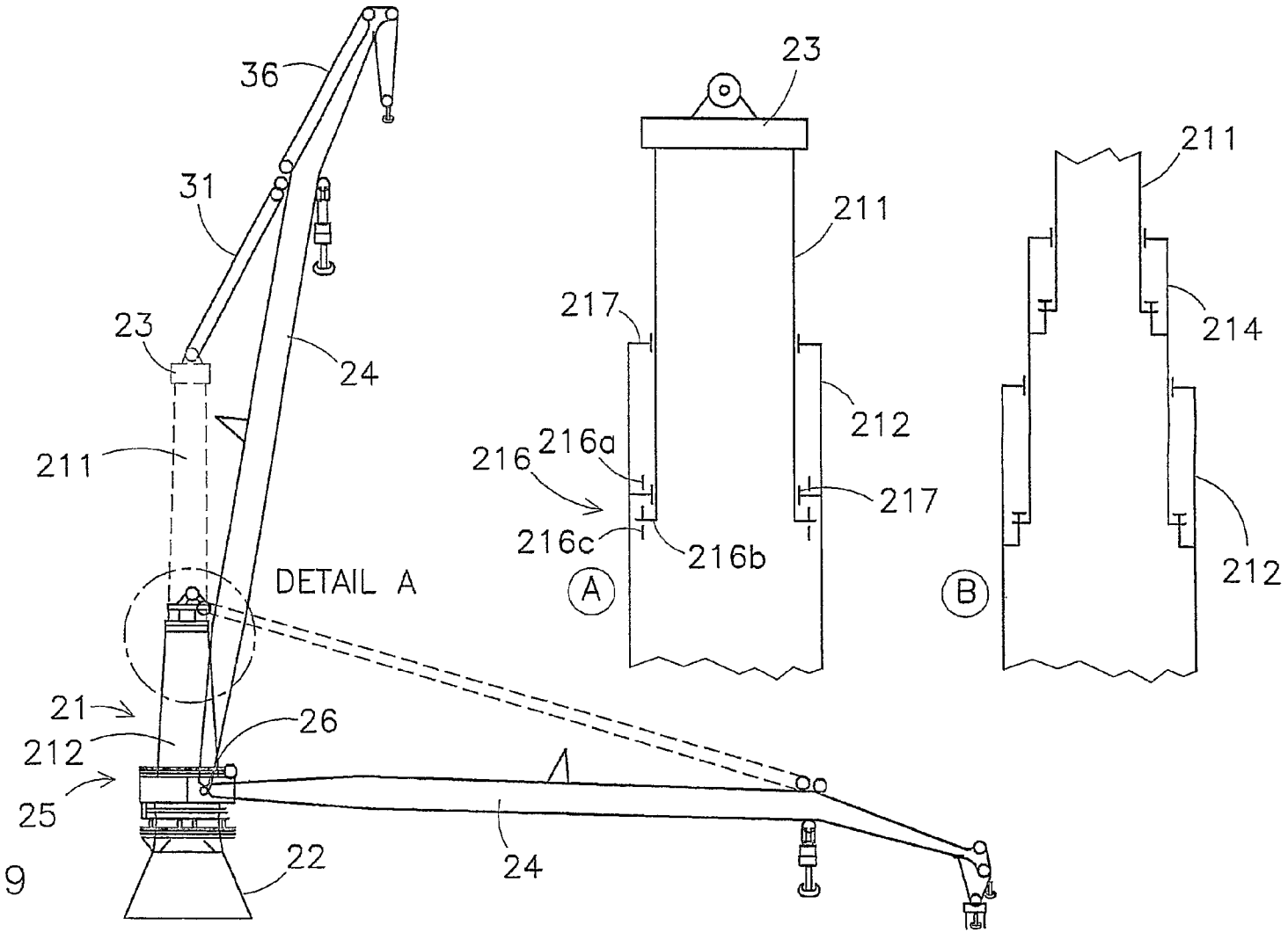
FIG. 9 shows schematically a hoisting crane according to the invention provided with a height adjustment arrangement.

FIG. 9 shows another exemplary embodiment of a hoisting crane according to the invention having a vertical column comprising at least two column parts. To provide a height-adjustment arrangement, the column parts are slidably connected to each other. Here, an upper column part 211 and a lower column part 212 is shown. In FIG. 9*b* a similar structure is shown comprising an intermediate column part 214. The upper column part 211 has a smaller diameter than the lower column part 212 and fits in a telescopic manner in the intermediate or lower column part. At the distal end, at the top of the upper column part a masthead is provided with a cable guide 40 and a cable pulley assembly 41. At the proximal end of the upper column part, a flange structure is provided to mount the upper column part to the lower column part. The flange structure 216 comprises two flanges which are each welded to one of the respective column parts. The flanges 216*a*, 216*b* are connected to each other by drive means 216*c*, like bolts, cylinders or screw spindles. The drive means 216*c* may also comprise a winch driving gear. The drive means 216*c* are arranged to move the upper column part 211 relative to the lower column part 212. The lower column part embraces the upper column part and has a slide bearing 217 at the distal end of it. At the proximal end of the upper column part 211 there is also a slide bearing provided. The slide bearing 217 and the flange structure 216 together guide and move the column parts relative to each other. To obtain a longer stroke of the movement of the upper column part, it is possible to arrange more than two column parts and provide more than one flange structure 216 together with a the slide bearing 217 as shown in FIG. 9*b*.

Figure 10:
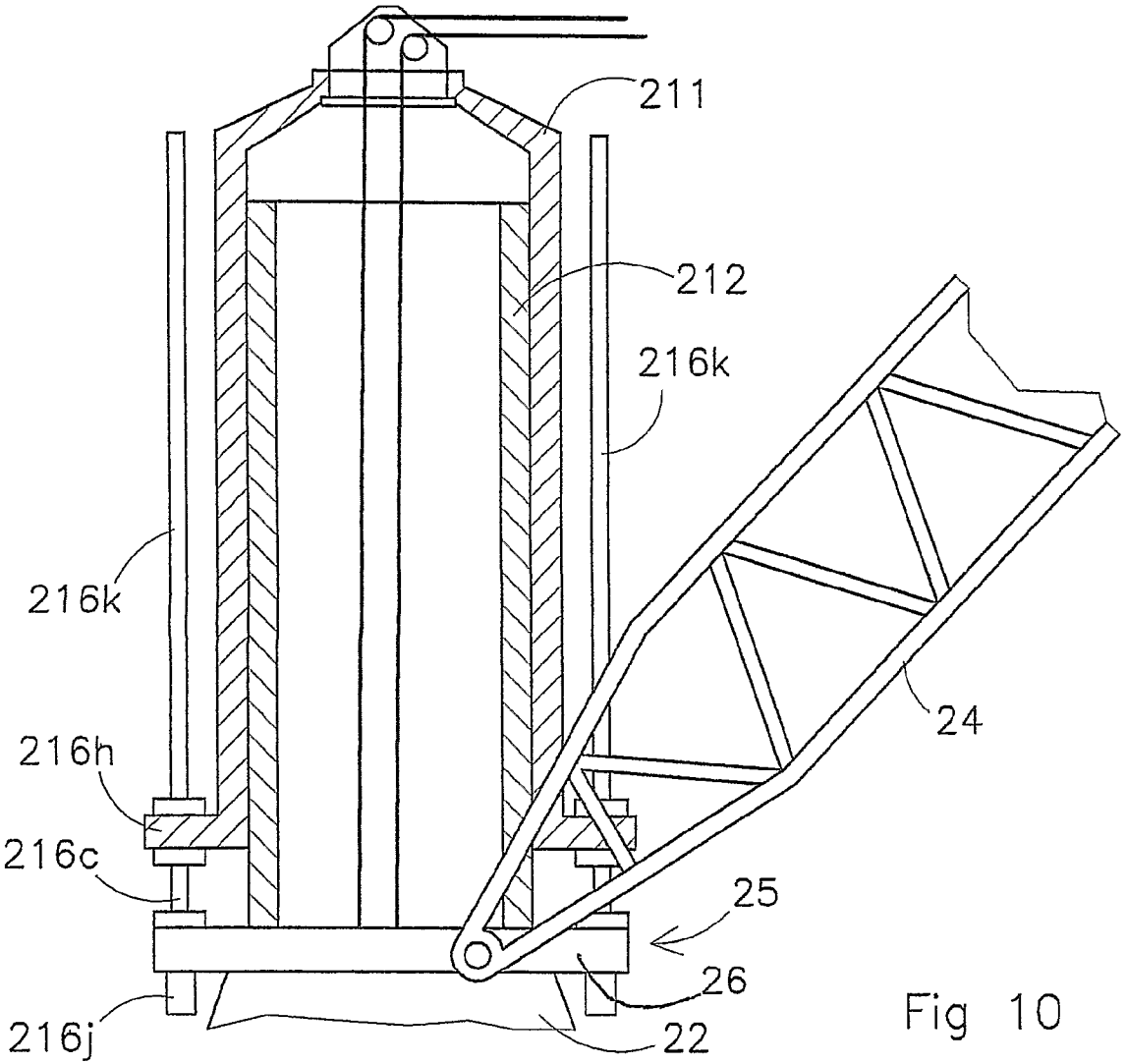
FIG. 10 shows schematically in detail a hoisting crane according to the invention provided with a height adjustment arrangement.

FIG. 10 shows another exemplary embodiment of a hoisting crane according to the invention having a vertical column comprising at least two column parts. To provide a height-adjustment arrangement the column parts are slidably connected to each other. The vertical column comprises a lower column part 212 and an upper column part 211 which embraces the lower column part 212. At the proximal end of the upper column part 211 a flange 216*h* is provided which is connected to the annular bearing structure 25 with drive means 216*c*, like bolts, hydraulic cylinders or screw spindles. Here, a plurality of drive means 216*c* are arranged in the form of a screw spindle comprising a lead screw 216*k* and a lead screw drive 216*j*.

In an alternative embodiment it is also possible to mount as drive means the housing of a hydraulic cylinder on the flange 216*h* and the piston head of the cylinder on the annular bearing structure 25. The upper column part 211 may be moved in a vertical direction by driving the drive means 216*c* to change the total height of the vertical column 21, which allows a vessel provided with a hoisting crane according to the invention to pass an obstacle on its way.

Figure 11B:
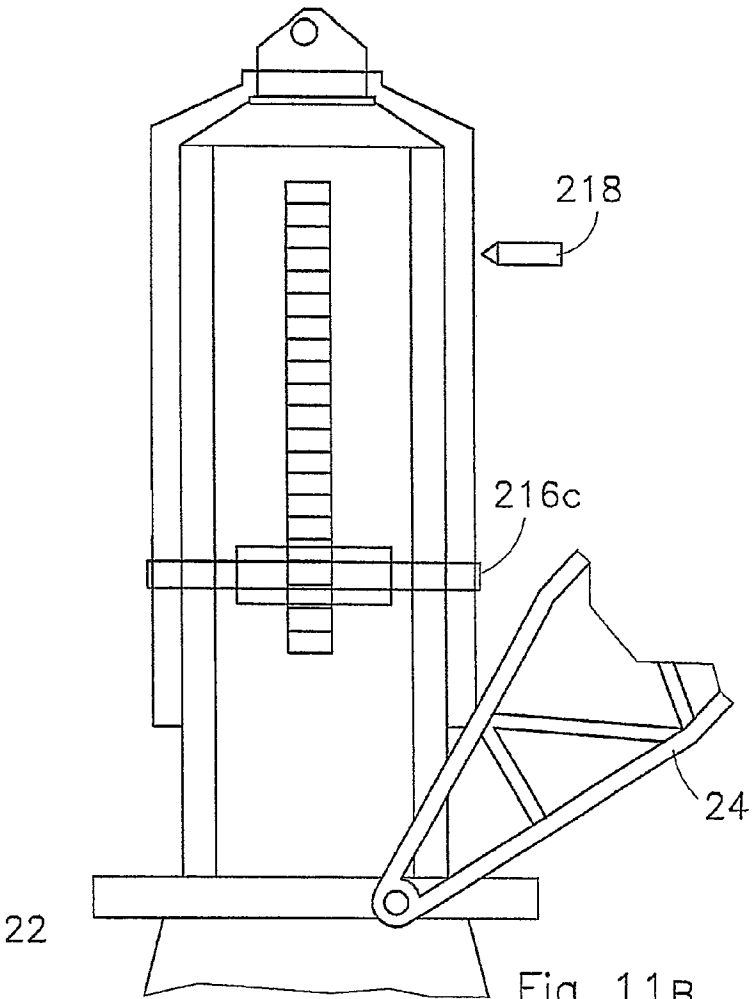
FIGS. 11A and 11B show schematically a vertical column of a hoisting crane according to the invention provided with a height adjustment arrangement.
Figure 11A:
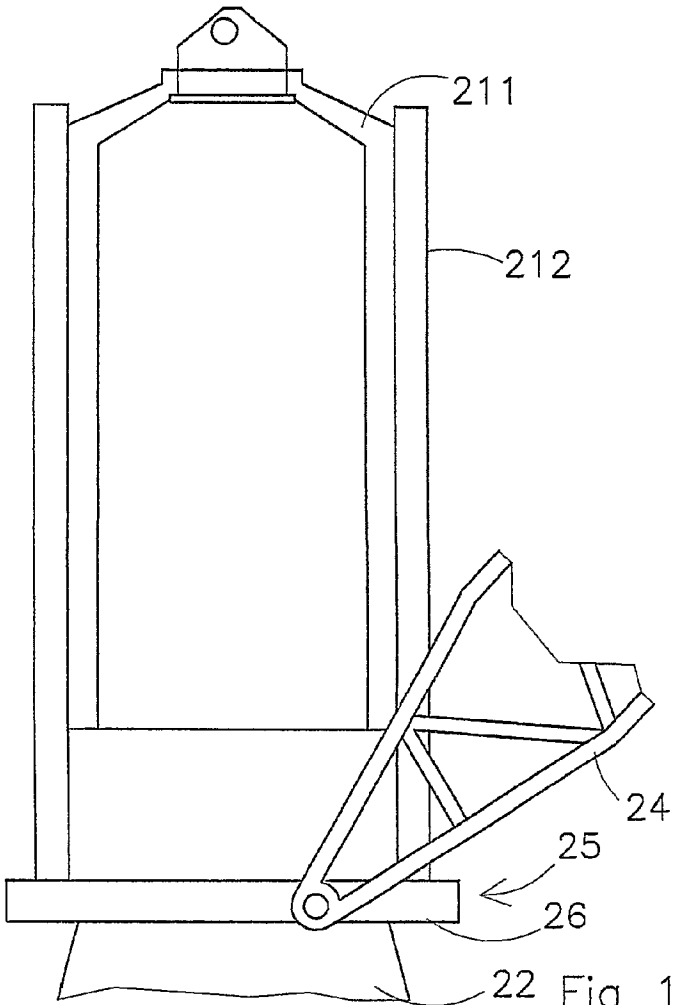

FIGS. 11A and 11B show another exemplary embodiment of a hoisting crane according to the invention. The illustrated hoisting crane has a vertical column which comprises an upper column part 211 and a lower column part 212. To provide a height-adjustment arrangement, the column parts are slidably connected to each other. The lower column part 212 has a foot 22 which may be fixed to the hull of a vessel. A jib 24 is connected to the lower column part via a connection member 26 and an annular bearing structure 25. The upper and lower column parts are cylindrically formed with substantially smooth surfaces which allow a guidance of the column parts with respect to each other. Herewith, the upper column part and the lower column part are telescopic connected to each other which allows a translation between the upper column part relative to the lower column part. A rack-and-pinion drive is provided as drive means 216*c* to move the upper column part relative to the lower column part to-and-fro a first lower transport position and a second upper working position. Locking means 218 are provided to lock the upper column part in predetermined positions, e.g. the first and second position or intermediate positions. These locking means may be for example bolts or hydraulic locking pins.

Figure 12:
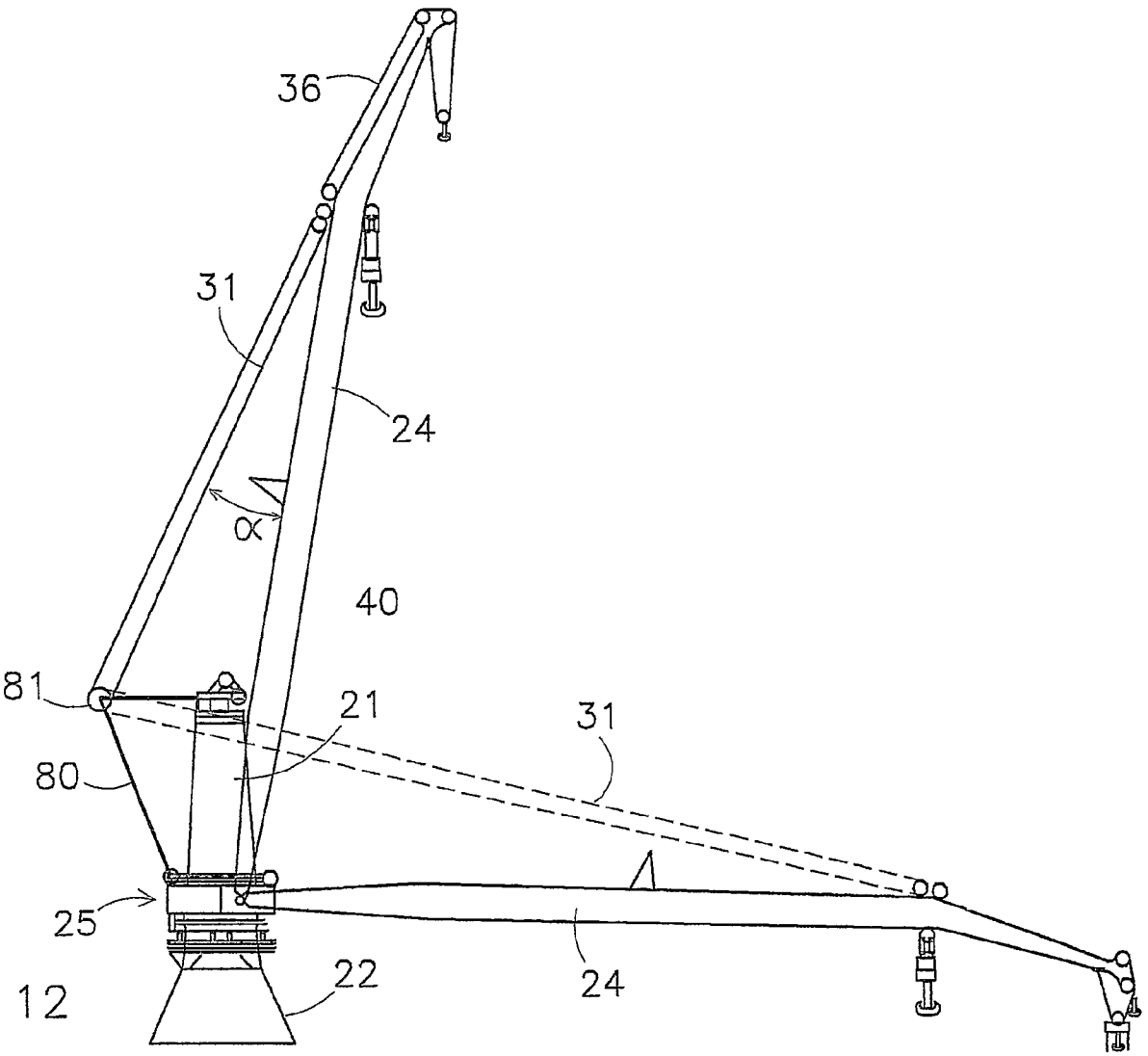
FIG. 12 shows schematically a hoisting crane according to the invention provided with a vertical column comprising a framework of bars.

FIG. 12 shows an alternative embodiment of the hoisting crane according to the invention. With respect to the vertical column of the prior art hoisting crane, as shown in FIG. 1, here the total height of the vertical column 21 is reduced. As already explained in the introductory of this application, the angle $\alpha$ between the topping cables and the jib is a limiting parameter when hoisting large and heavy objects. When the angle $\alpha$ becomes too small, too much tension is introduced in the topping cables. This implies that a vertical column 21 with a certain height is necessary to bring the jib in an upstanding position.

In the embodiment of the hoisting crane according to the invention which is shown in FIG. 12 the total height of the vertical column 21 is reduced and a subframe 80 is mounted on the annular bearing structure 25 and on the cable guide 40. The subframe 80 is generally positioned opposite the jib 24. The subframe 80 is rotatable together with the annular bearing structure 25 and the guide 40. The subframe 80 comprises an intermediate topping cable guide 81. in this example two topping cables 31 run from winches 30 inside the foot 22 of the vertical column 21 via the top 23 of the vertical column 21 to the intermediate topping cable guide 81. From there the topping cables 31 run symmetrically along each side of the vertical column 21 to the jib 24. In an upstanding position of the jib 24, the angle $\alpha$ is large enough to limit the tensions that will be introduced into the topping cables 31. When the jib 24 is positioned in a substantially horizontal position, the total height of the vertical column including the subframe 80 is low enough to pass overhanging structures like bridges etc. Thus, with this improvement to the vertical column it is possible to obtain a hoisting crane with a limited total height to pass obstacles, but with enough strength to handle large and heavy objects.

Figure 13:
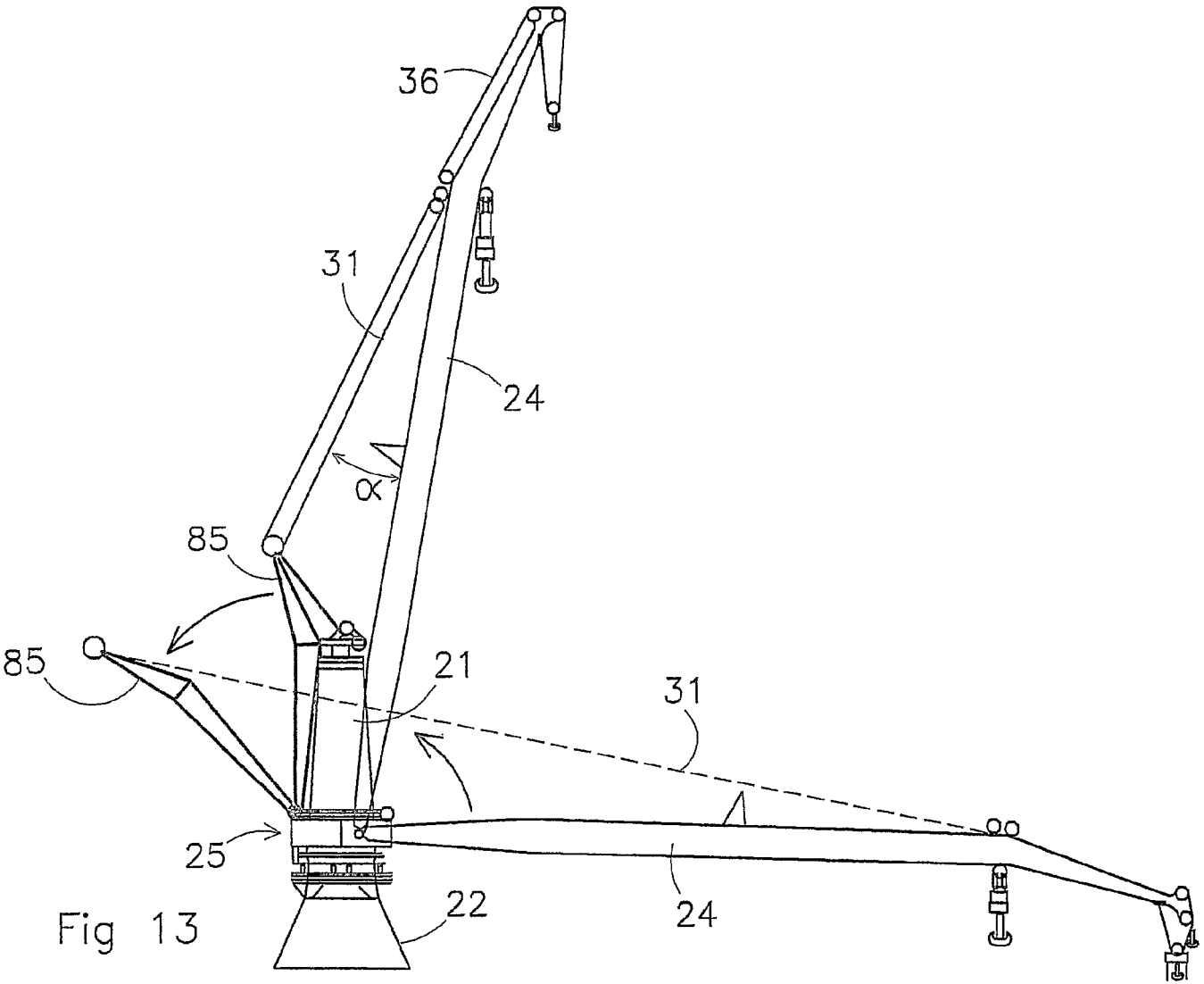
FIG. 13 shows schematically a hoisting crane according to the invention.

As in FIG. 12, FIG. 13 shows an alternative embodiment of the hoisting crane wherein the column has a reduced height. A pivotable subframe 85 is provided, which is pivotally mounted to the annular bearing structure 25. The subframe 85 is positioned opposite the jib 24 and is rotatable (slewing motion) together with the jib 24. The subframe 85 can be positioned in a raised working position and a lower transport position. In the working position the intermediate topping cable guide assembly 81 is arranged significantly higher than the top end of the column with guide 40 at a position which is high enough to increase the angle $\alpha$ between the topping cables 31 and the jib 24 in an upstanding position to an acceptable degree. In the transport position the subframe 85 is turned downwards till the total height of the crane is reduced enough.

Figure 14:
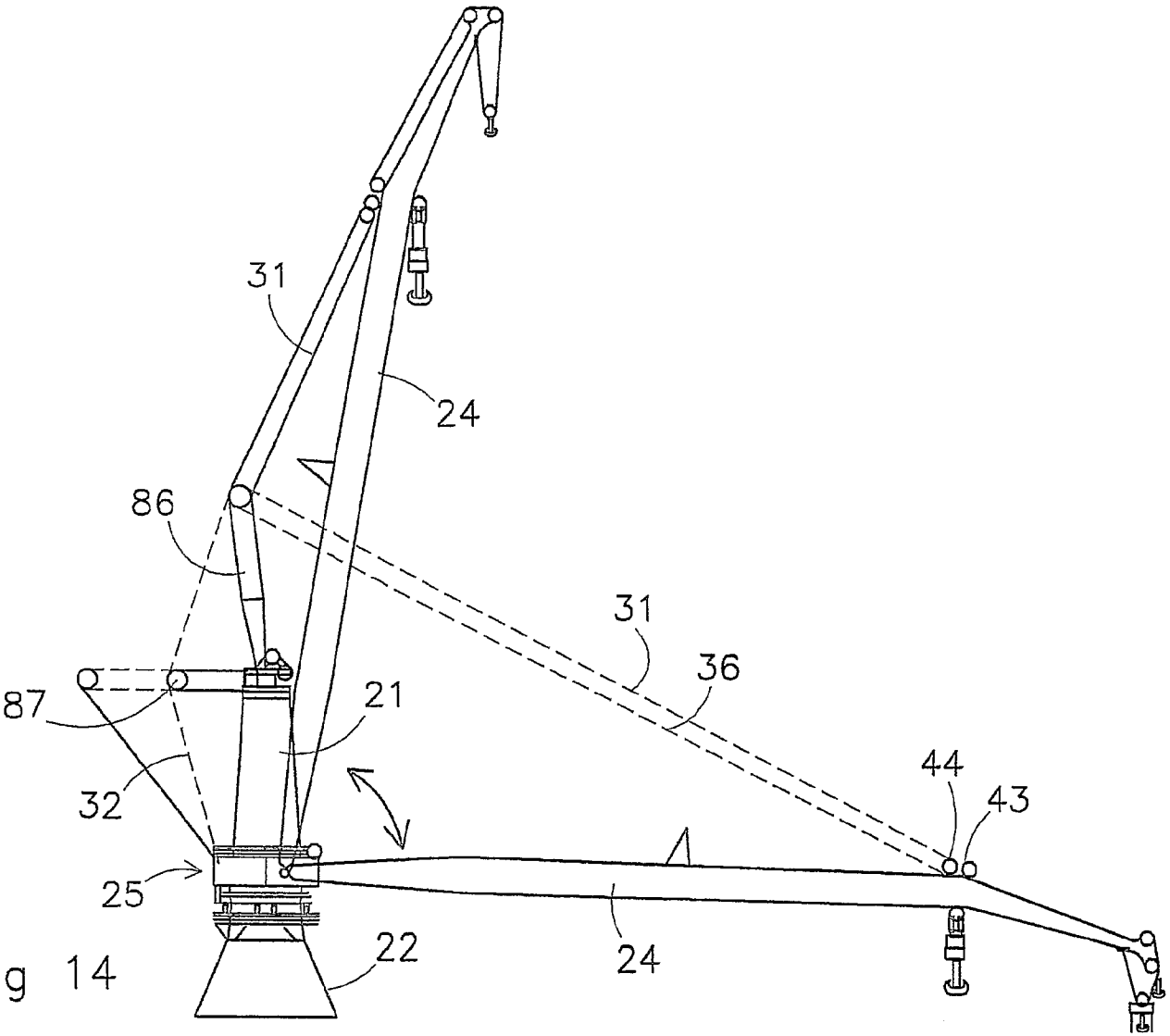
FIG. 14 shows schematically a hoisting crane according to the invention having a pivotable subframe connected to the column top cable guide.

FIG. 14 shows an embodiment of the hoisting crane according to the invention, wherein a subframe 86 is connected pivotally to the column top cable guide mounted at the top of the vertical column. A hoisting cable 36 and a topping cable 31 are guided from the column top cable guide at the top of the vertical column via the distal end of the subframe 86 to the cable pulley assemblies 43, 44 at the distal end of the jib 24. Like in the embodiments shown in FIGS. 12 and 13 the height of the vertical column 21 is limited, now by the presence of the pivotal subframe. The subframe 86 is provided in the illustrated embodiment to increase in spite of the limited length of the vertical column the capacity of the hoisting crane.

Advantageously, the pivotable subframe 86 is used during hoisting to provide a suitable angle $\alpha$ in both the upstanding position as in the substantially horizontal position of the jib 24.

A control cable 32 can be used to pivot the subframe 86. The control cable 32 here is guided by a fixed subframe 87, which is connected to the top of the vertical column.

When the subframe 86 is brought in a substantially horizontal position, the total height of the hoisting crane is substantially determined by the height of the vertical column. Herewith, the hoisting crane according to the invention in this embodiment provides a hoisting crane with a limited height, which allows the hoisting crane to pass overhanging structures, like bridges, but is still capable to hoist large, tall and heavy objects.

Figure 15A:
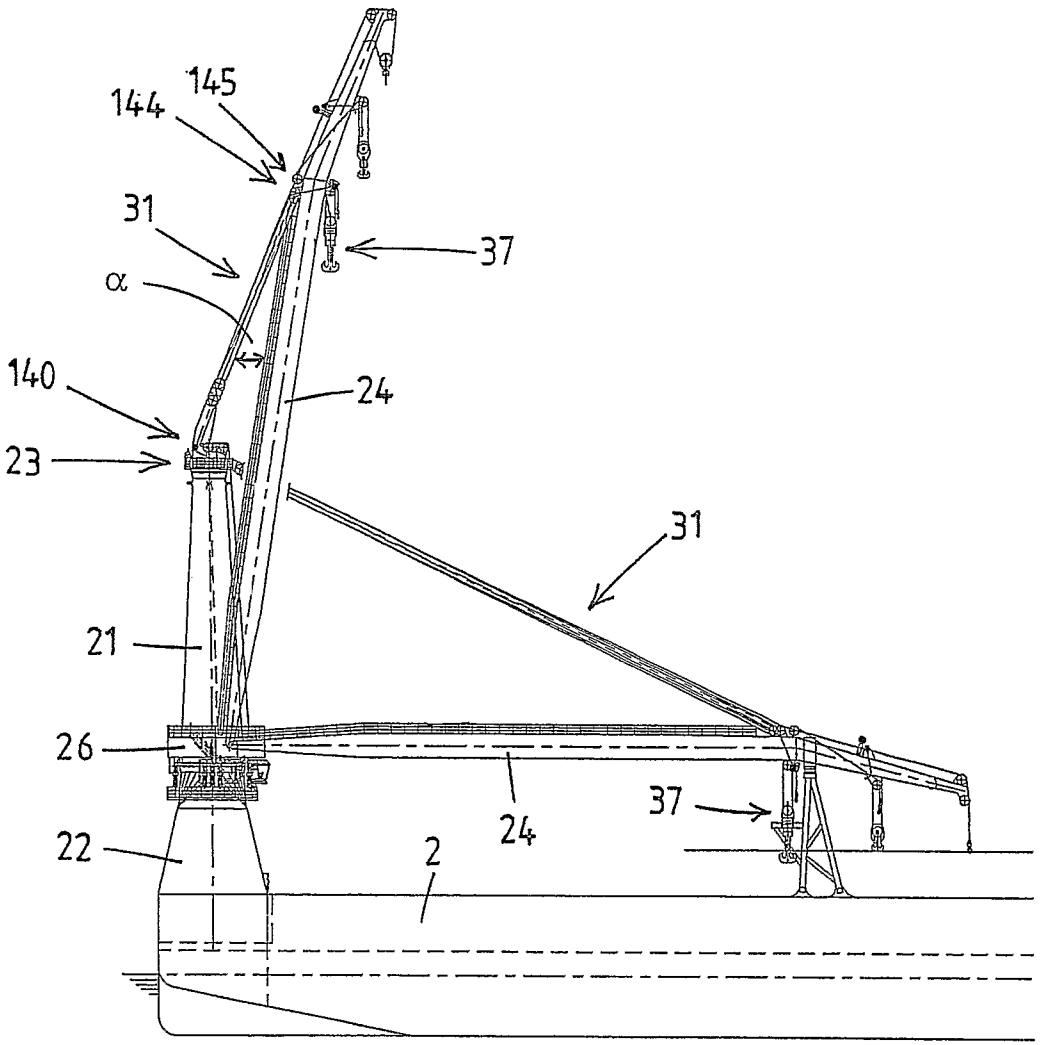
FIGS. 15A, B show schematically a portion of a vessel equipped with a crane according to the invention and on an enlarged scale the area near the top of the vertical column respectively.

In FIGS. 15A, B a hoisting crane is shown having parts the same or similar to the crane shown in FIG. 1 which have been denoted with the same reference numerals.

Figure 15B:
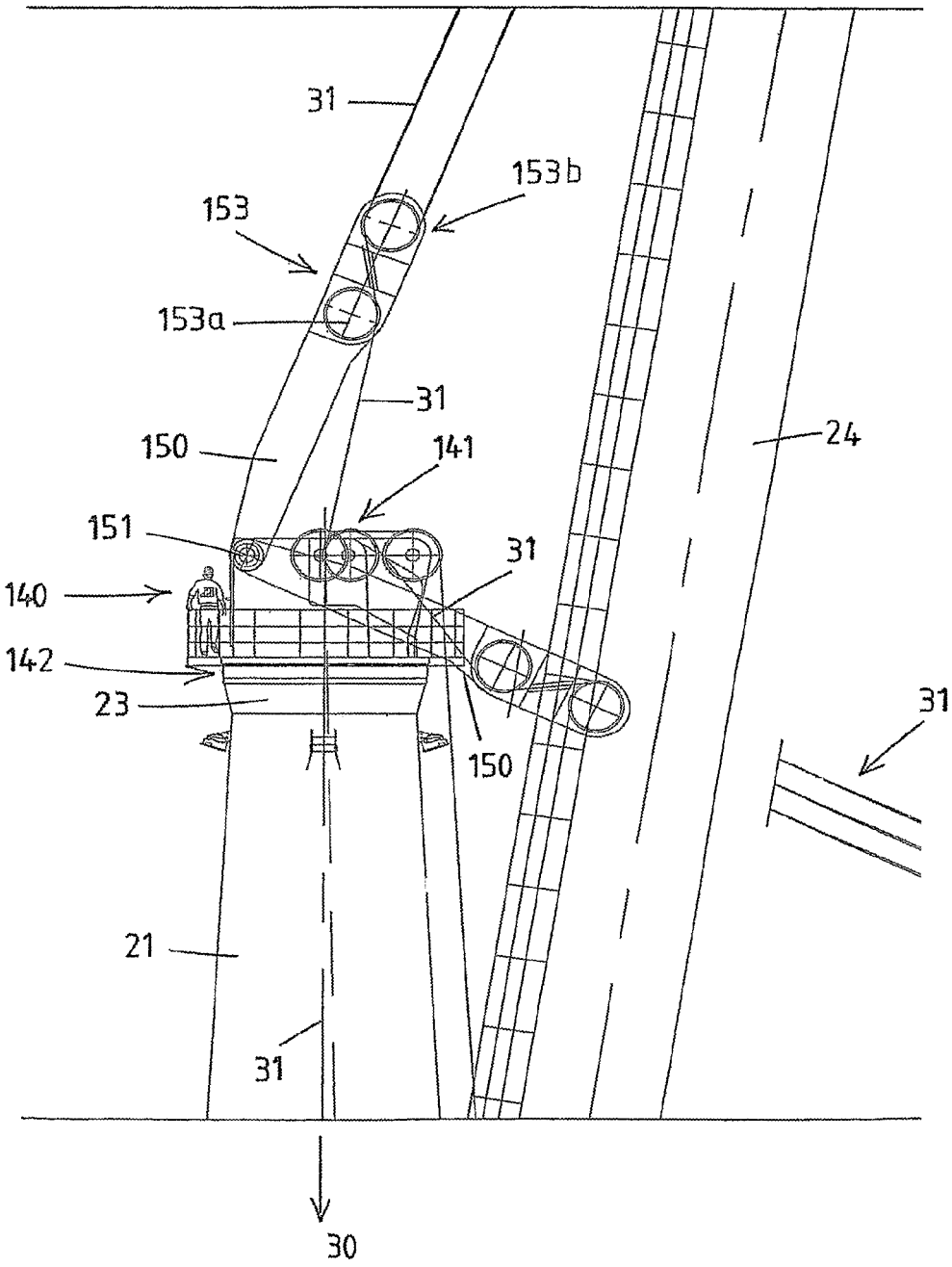

As is best seen in FIG. 15B a column top cable guide 140 is provided on the top 23 of the column 22, which guide 140 has a topping cable and hoisting cable pulley assembly 141 with one or more pulleys guiding the topping cable 31 and one or more pulleys guiding the hoisting cable (not shown).

The topping winch 30 and the hoisting winch are mounted in the foot of the crane, such that the hoisting cable and the topping cable extend from the associated winch upward through the column to the column top cable guide 140 and from said column top cable guide 140 to the jib 24, wherein the jib 24 has topping cable pulley assembly 144 for the topping cable 31 and a hoisting cable pulley assembly 145 for the hoisting cable.

As in FIG. 1 the column top cable guide 140 is mounted via an associated rotary bearing structure 142 at the top of the column, such that said column top cable guide 140 follows rotary (slewing) movements of the jib 24 about the vertical column and adopts substantially the same angular position as the jib 24.

In FIGS. 15A, B it can be recognized that a mobile subframe 150 is mounted on column top cable guide 140 (shown in FIG. 15*b* in two positions, corresponding to the topped position of the jib and the position of the jib when resting on the boomrest 11 of the vessel (see FIG. 1).

This mobile subframe 150 is pivotally connected to the cable guide 140 so as to allow for free up and down pivoting of the subframe 150 about pivot axis 151 in response to topping motion of the jib 24. The absence of a drive to effect the pivoting motion of the subframe is advantageous in view of costs and reliability. Of course a drive (e.g. one or more hydraulic cylinders or a control cable as in FIG. 14) could be associated with the mobile subframe allowing to position the subframe as desired.

The subframe 150 supports an intermediate topping cable pulley assembly 153 at a position remote from the pivot axis 151, preferably near the free end of the subframe 150. In this example the assembly 153 includes a pulley 153*a* guiding the single fall topping cable 31 that emerges from the column 22 and a set of pulleys 153*b* along which the multiple falls of the topping cable 31 are passed that extend to the set of pulleys of assembly 144.

In the topped position of the jib 24 the angle $\alpha$ between the jib 24 and the topping cable 31 is greater than the angle between jib 24 and an imaginary line from the topping cable pulley assembly 144 on the jib 24 to the topping cable pulley assembly 141 on the column top cable guide 140. As explained this increased angle $\alpha$ reduces the tension in the topping cable and so allows for a greater topping angle of the jib.

As can be seen best in FIG. 15*b* the subframe 150 finds itself effectively in a raised position when the jib is topped and in a lowered position when the jib 24 is in a generally horizontal position and/or lying on the boomrest. In the lowered position—as is preferred—the subframe 150 finds itself below the top end of the column top cable guide 140, so that said guide 140 defines the effective height of the crane during travel of the vessel.

As can be seen the subframe 150 has a substantial length between the pivot axis 151 and the assembly 153, preferably at least 3 meters, more preferably at least 5 meters, in a practical preferred version between 7 and 20 meters. This allows for a substantial reduction of height of the column when compared to the FIG. 1 prior art crane.

In this example the subframe 150 includes two parallel side beams, each pivoted to the guide 140 at opposite sides thereof, so that in the lowered position the guide 140 finds itself between said side beams.

As is preferred the pivot axis 151 is located at a distance from the centerline of the column (here also the rotary axis of the guide 140) at the side of the guide 140 facing away from the jib 24.

The assembly 153 is positioned—as is preferred—such on the subframe 150 that the forces of the falls of the topping cable 31 act on the subframe 150—in all pivotal positions of the subframe—at a location closer to the jib than the rotary axis of the guide 140, which ensures a stable position of the guide 140.

The invention claimed is:

1. A hoisting crane, comprising:

a substantially hollow vertical column with a foot which is or can be fixed to a support, and with a top;

an annular bearing structure, which extends around the vertical column and guides and carries a jib connection member, so that the jib connection member can rotate around the column;

a jib connected to the jib connection member, the jib connection member forming a substantially horizontal pivot axis so that the jib can be pivoted up and down;

a column top cable guide having a first topping cable pulley assembly and a first hoisting cable pulley assembly;

a topping winch and an associated topping cable for pivoting the jib up and down; and a hoisting winch and an associated hoisting cable for hoisting a load, wherein the topping winch and the hoisting winch are disposed such that the hoisting cable and the topping cable extend from the associated winch upward through the column to the column top cable guide and from said column top cable guide to the jib, wherein the jib has a second topping cable pulley assembly for the topping cable and a second hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, and wherein a mobile subframe is mounted on the column top cable guide, said mobile subframe supporting an intermediate topping cable pulley assembly along which the topping cable passes between the column top cable guide and the jib, such that, in a topped up position of the jib, an angle between the jib and the topping cable is greater than the angle between the jib and an imaginary line from the topping cable pulley assembly on the jib to the topping cable pulley assembly on the column top cable guide.

2. The crane according to claim 1, wherein the mobile subframe is connected pivotally to the column top cable guide allowing the subframe to pivot up and down.

3. The crane according to claim 2, wherein the mobile subframe is free to pivot such that the orientation thereof is governed by the orientation of the jib.

4. The crane according to claim 2, wherein a drive is associated with the mobile subframe allowing positioning the subframe as desired.

5. The crane according to claim 2, wherein the distance between the pivot axis of the subframe and the intermediate topping cable pulley assembly is between 7 and 20 meters.

6. The crane according to claim 1, wherein the subframe finds itself effectively in a raised position when the jib is topped and in a lowered position when the jib is in a generally horizontal position and/or lying on a boomrest, and wherein, in the lowered position, the subframe finds itself below the top end of the column top cable guide, so that said guide then defines the effective height of the crane.

7. A vessel equipped with the crane according to claim 1.

8. A hoisting crane, comprising:

a substantially hollow vertical column with a foot which is or can be fixed to a support, and with a top;

an annular bearing structure, which extends around the vertical column and guides and carries a jib connection member, so that the jib connection member can rotate around the column;

a jib connected to the jib connection member, the jib connection member forming a substantially horizontal pivot axis so that the jib can be pivoted up and down;

a column top cable guide having a first topping cable pulley assembly and a first hoisting cable pulley assembly;

a topping winch and an associated topping cable for pivoting the jib up and down; and a hoisting winch and an associated hoisting cable for hoisting a load, wherein the topping winch and the hoisting winch are disposed such that the hoisting cable and the topping cable extend from the associated winch upward through the column to the column top cable guide and from said column top cable guide to the jib, wherein the jib has a second topping cable pulley assembly for the topping cable and a second hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, and wherein the vertical column comprises at least a lower and an upper column part, the lower column part being integral with the foot, the annular bearing structure extending around the lower column part, the cable guide being arranged on the top of the upper column part, the upper and lower column part being connected to each other by a height adjustment arrangement, which permits the upper column part to move relative to the lower column part between a working position in which the column top cable guide is at a working distance from the jib connection member, and a transport position wherein the total height of the vertical column is reduced with respect to the working position, and wherein the distance between the column top cable guide and the jib connection member has decreased, and the position of the jib connection member has not changed.

9. The hoisting crane according to claim 8, wherein the height adjustment arrangement includes one or more intermediate column parts arranged between the upper and lower column parts.

10. The hoisting crane according to claim 8, wherein the height-adjustment arrangement comprises cooperating screw threads, wherein a vertical translation of the upper column part is achieved by rotating at least one of the screw threads.

11. The hoisting crane according to claim 8, wherein the height-adjustment arrangement is a pivot assembly, which pivotally connects the upper column part to the lower column part.

12. The hoisting crane according to claim 8, wherein the height-adjustment arrangement comprises slide bearings to guide the upper column part relative to the lower column part and a drive configured to drive the upper column part vertical relative to the lower column part.

13. The hoisting crane according to claim 12, wherein the upper column part is received into the lower column part when moving to the transport position.

14. The hoisting crane according to claim 12, wherein the drive comprises hydraulic cylinders.

15. A vessel equipped with the crane according to claim 8.

16. A hoisting crane, comprising:

a substantially hollow vertical column with a foot which is or can be fixed to a support, and with a top;

an annular bearing structure, which extends around the vertical column and guides and carries a jib connection member, so that the jib connection member can rotate around the column;

a jib connected to the jib connection member, the jib connection member forming a substantially horizontal pivot axis so that the jib can be pivoted up and, down a column top cable guide having a first topping cable pulley assembly and a first hoisting cable pulley assembly;

a topping winch and an associated topping cable for pivoting the jib up and down; and a hoisting winch and an associated hoisting cable for hoisting load, wherein the topping winch and the hoisting winch are disposed such that the hoisting cable and the topping cable extend from the associated winch upward through the column to the column top cable guide and from said column top cable guide to the jib, wherein the jib has a second topping cable pulley assembly for the topping cable and a second hoisting cable pulley assembly for the hoisting cable, wherein the column top cable guide is mounted via an associated rotary bearing structure at the top of the column, such that said column top cable guide follows rotary movements of the jib about the vertical column and adopts substantially the same angular position as the jib, and wherein external to the vertical column a subframe is provided, which subframe is connected to the jib connection member and has an intermediate topping cable guide opposite the jib, spaced at a radial distance from the vertical column to increase the angle between the topping cable and the jib.

17. The hoisting crane according to claim 16, wherein the subframe is fixed to both the jib connection member and the column top cable guide.

18. The hoisting crane according to claim 16, wherein the subframe is pivotally connected to the jib connection member via a pivot axis, the subframe being movable between a raised working position and a lower transport position.

19. A vessel equipped with the crane according to claim 16.

* * * * *